United States Patent [19]

Saito

[11] Patent Number: 4,576,468

[45] Date of Patent: Mar. 18, 1986

[54] CLEANING APPARATUS OF ELECTROPHOTOGRAPHIC COPYING MACHINE

[75] Inventor: Kinzi Saito, Kawasaki, Japan

[73] Assignee: Ricoh Company, Ltd., Tokyo, Japan

[21] Appl. No.: 603,397

[22] Filed: Apr. 24, 1984

[30] Foreign Application Priority Data

May 12, 1983 [JP] Japan ..... 58-81633
Jun. 10, 1983 [JP] Japan ..... 58-102730

[51] Int. Cl.[4] ..... G03G 21/00
[52] U.S. Cl. ..... 355/15; 15/256.51
[58] Field of Search ..... 355/3 R, 15; 15/256.51, 15/256.52

[56] References Cited

U.S. PATENT DOCUMENTS 3,848,992 11/1974 Smith ..... 355/15
4,152,067 5/1979 Kubota ..... 355/15
4,334,766 6/1982 Sugiyama et al. ..... 355/15
4,451,139 5/1984 Yanagawa et al. ..... 355/15
4,498,760 2/1985 Sugiyama ..... 355/15

*Primary Examiner*—Fred L. Braun
*Attorney, Agent, or Firm*—Flynn, Thiel, Boutell & Tanis

[57] ABSTRACT

The cleaning apparatus includes a pair of parallel elastic plates, corresponding end portions of the elastic plates are integrally connected to each other, and the other end portions of the elastic plates are fixed to an arm member which is urged towards the photoconductor drum, and a cleaning blade member is fixed to one of the elastic plates, with a top portion of the cleaning blade member projecting from the elastic plate and being in pressure contact with the surface of the photoconductor drum with a predetermined pressure, and with the angle $\theta$ between the upstream side of the cleaning blade in terms of the rotation of the photoconductor drum and the tangent at the contact point of the blade with the surface of the photoconductor drum is less than $\pi/2$.

4 Claims, 5 Drawing Figures

CLEANING APPARATUS OF ELECTROPHOTOGRAPHIC COPYING MACHINE

BACKGROUND OF THE INVENTION

The present invention relates to a cleaning apparatus of an electrophotographic copying machine.

In a conventional electrophotographic copying machine, for instance, a cleaning apparatus of a trailing type as shown in FIG. 1 is employed for cleaning residual toner off the photoconductor drum of the copying machine, which comprises an arm 2 which is swingable towards a photoconductor drum 1, a metallic thin plate 3 whose base portion is fixed to a top end portion of the arm 2, and a cleaning blade member 4 which is made of an elastic material such as rubber and is attached to the underside of the metallic thin plate 3. The blade member 4 is brought into pressure contact with the surface of the photoconductor drum 1 with a predetermined pressure by a spring member 5 which is connected to the arm 2 as shown in FIG. 1.

This cleaning apparatus has the shortcoming that as the photoconductor drum 1 is rotated in the direction of the arrow as shown in FIG. 1, the contact point of the blade member 4 with the surface of the photoconductor drum 1 is shifted from position $P_1$ to position $P_2$, since the force is applied to the blade member 4 in the direction of the tangent at the position $P_1$ and the metallic plate 3 is curved as shown by the broken lines. Thus, the angle $\theta_1$ between the lower side of the blade member 4 and the tangent at the point $P_1$ is decreased to $\theta_2$. As a result, the cleaning performance of the cleaning apparatus is significantly decreased. In particular, in the course of the cleaning operation, when the blade member 4 comes into contact with a non-image area where there is substantially no toner on the photoconductor drum 1 and where the friction between the blade member 4 and the surface of the photoconductor drum 1 is much greater than in an image areas where toner is abundant, the blade member 4 is slightly shifted in the downstream direction in terms of the rotation of the photoconductor drum 1, away from a normal cleaning position, due to the greater friction and the force applied to the blade member 4 in the direction of the tangent at the contact point of the blade member 4 with the photoconductor drum 3. As mentioned above, in such a shifted state, the cleaning performance of the blade member 4 is decreased. Immediately after this, even if the thus shifted blade member 4 comes into contact with an image area where there is residual toner and the friction between the blade member 4 and the surface of the photoconductor drum 1 is less, the blade 4 remains shifted, with the decreased cleaning performance being maintained. Furthermore, depending upon the conditions of the surface of the photoconductor drum 1, including the presence or non-presence of toner thereon, the metallic thin plate and blade are caused to vibrate.

SUMMARY OF THE INVENTION

It is therefore an object of the present invention to provide a trailing type cleaning apparatus of an electrophotographic copying machine, in which the contact angle between the tip of a cleaning blade member and the surface of a photoconductor drum of the copying machine is kept constant during the course of the cleaning operation, whereby high cleaning performance is retained, even if the blade member is shifted in the downstream direction of the rotation of the photoconductor drum during the cleaning operation.

Another object of the present invention is to provide a cleaning apparatus of the above-mentioned type with the vibrations of the cleaning blade minimized in the course of the cleaning operation.

DETAILED DESCRIPTION OF THE PREFERRED EMBODIMENTS

Figure 1:
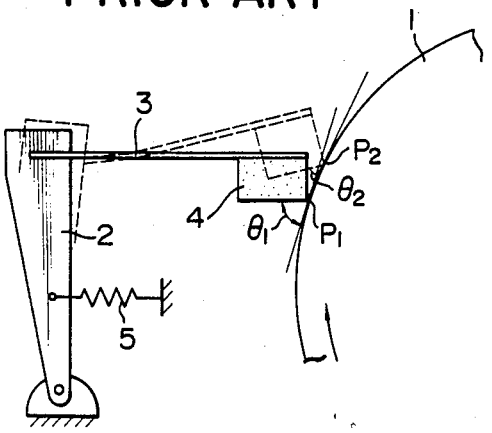
FIG. 1 PRIOR ART
FIG. 1 is a front view of a conventional trailing type cleaning apparatus of an electrophotographic copying machine.
Figure 2:
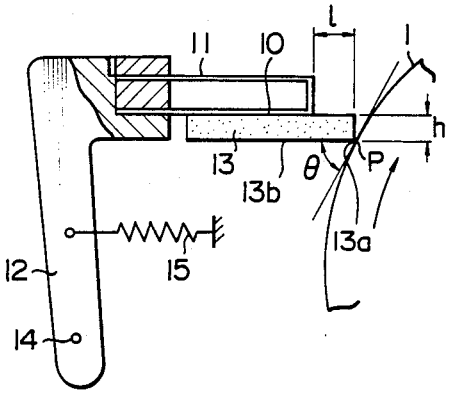
FIG. 2 is a front view of an embodiment of a trailing type cleaning apparatus according to the present invention when a photoconductor drum is stopped.
Figure 3:
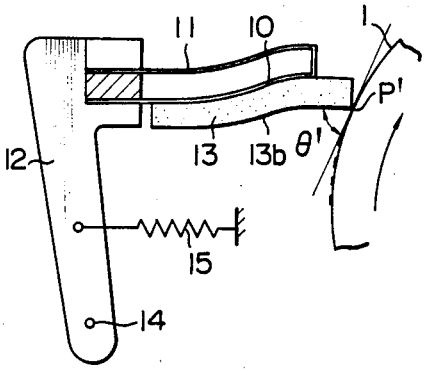
FIG. 3 is a front view of the embodiment of a trailing type cleaning apparatus according to the present invention shown in FIG. 2 when the photoconductor drum is in rotation.

Referring to FIG. 2 and FIG. 3, an embodiment of a cleaning apparatus according to the present invention will now be explained. In the figures, reference numerals 10 and 11 indicate a pair of parallel elastic plates with a predetermined space therebetween. These parallel elastic plates are integrally connected to each other at the front (rightward) portion thereof as shown in those figures. The rear (leftward) portion of these parallel plates are fixed to a top portion of an arm 12. A cleaning blade 13 made of an elastic material, such as rubber, is attached to the elastic plate 10 in such a manner that the front portion of the cleaning blade 13 projects a predetermined distance, l, from the front end of the elastic plate 10, and is in contact with the surface of a photoconductor drum 1. It is preferable that the projected length of the cleaning blade 13 be in the range of $0<l\leqq 2h$ wherein h is the thickness of the cleaning blade 13.

The arm 12 is disposed so as to be swingable about a shaft 14 disposed at a lower end portion of the arm 12. The arm 12 is urged by a spring member 15 in such a manner that an edge portion 13*a* of the blade 13 is brought into pressure contact with the surface of the photoconductor drum 1 with a predetermined pressure. Furthermore, the angle $\theta$ between the lower side 13*b* of the blade 13 on the upstream side of the rotation of the photoconductor drum 1 and the tangent at the contact point P of the blade 13 with the surface of the photoconductor drum 1 satisfies the relationship of $0<\theta<\pi/2$. In other words, this cleaning apparatus is of a trailing type.

The operation of this cleaning apparatus will now be explained.

As the photoconductor drum 1 is rotated in the direction of the arrow, the contact point P is moved in the downstream direction of the rotation of the photoconductor drum 1 by the force generated by the friction between the blade 13 and the photoconductor drum 1. However, because of the rectangular structure of the two elastic parallel plates 10 and 11 with attachment of the cleaning blade 13 thereto, because of the high rigidity of the tip portion, and because of the short length of the free end portion of the blade 13, even if the above-mentioned force is applied to the tip of the blade 13 so that the tip of the blade 13 is moved in the downstream direction of the rotation of the photoconductor drum 1, the free end portion of the blade 13 makes a parallel movement in the downstream direction of the rotation of the photoconductor drum 1 without any substantial deformation, that is, from the position P shown in FIG. 2 to the position P′ shown in FIG. 3, and the above-mentioned force is absorbed by the deformation of the middle portions of the two elastic parallel plates 10 and 11 and of the cleaning blade 13. Therefore, in the course of the cleaning operation, the angle $\theta'$ between the lower side 13*b* of the blade 13 on the upstream side of the rotation of the photoconductor drum 1 and the tangent at the contact point P′ of the blade 13 with the surface of the photoconductor drum 1 remains substantially the same as the angle $\theta$ at the time of the photoconductor drum 1 being stopped. As a result, the high cleaning performance of the blade 13 is retained.

Figure 4:
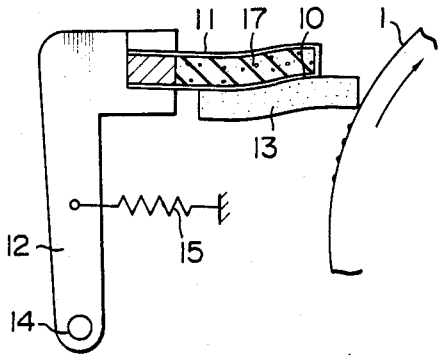
FIG. 4 is a front view of another embodiment of a cleaning apparatus according to the present invention when a photoconductor drum is in rotation.

Referring to FIG. 4, there is shown another embodiment of a cleaning apparatus according to the present invention. In this embodiment, a foam rubber pad 17 for absorbing and minimizing vibrations of the blade 13 is inserted between the parallel elastic plates 10 and 11, whereby improper operation of the cleaning apparatus is avoided.

Figure 5:
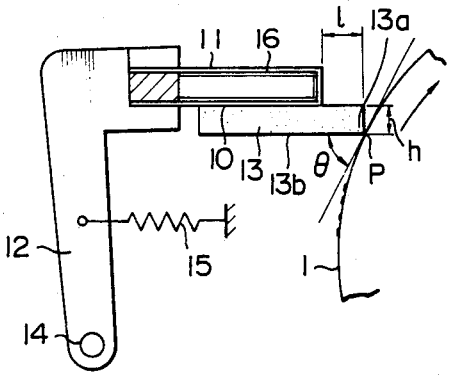
FIG. 5 is a front view of a further embodiment of a cleaning apparatus according to the present invention when a photoconductor drum is stopped.

Referring to FIG. 5, there is shown a further embodiment of a cleaning apparatus according to the present invention. In this embodiment, the inside of the elastic parallel plates 10 and 11 is lined with a viscous vibration-absorbing material 16, for instance, an adhesive transfer tape which is commercially available from Sumitomo 3M Limited under the name of Isotac 9460.

The tip portion of the two parallel elastic plates 10 and 11 can be constructed by fixing a square metallic rod or a square elastic rod made of, for instance, rubber, between the tip portions of the two parallel elastic plates 10 and 11. The fixing of the square metallic rod to the elastic plates 10 and 11 can be done by use of an adhesive agent or by welding. The rubber rod can be fixed to the plates by use of an adhesive agent.

Thus, according to the present invention, even if the cleaning blade which is in contact with the surface of a photoconductor drum is shifted in the rotating direction of the photoconductor by the friction between the blade and the surface of the photoconductor drum, the top portion of the blade makes a parallel movement from the original position without deformation, whereby the contact angle of the cleaning blade with the surface of the photoconductor drum is maintained and therefore the high cleaning performance of the cleaning apparatus is maintained throughout the cleaning operation. Furthermore, since a vibration-absorbing material is applied to the inside of the two parallel plates which support the cleaning blade, or a vibration absorbing material is inserted between the two parallel plates, the vibrations of the cleaning blade are minimized, so that high cleaning performance of the blade is attained and the life of the cleaning blade can be extended.

What is claimed is:

1. A cleaning apparatus of an electrophotographic copying machine for cleaning a photoconductor drum of the electrophotographic copying machine comprising:

a pair of parallel elastic plates, one end portion of said elastic plates being integrally connected to each other, and the other end portion of said elastic plates being fixed to an arm member which is urged towards said photoconductor drum, and a cleaning blade member which is fixed to one of said elastic plates, with a free end portion of said cleaning blade member projecting from said one elastic plate toward the surface of said photoconductor drum and being in pressure contact with the surface of said photoconductor drum with a predetermined pressure, and the angle between the upstream side of said cleaning blade in terms of the rotation of said photoconductor drum and the tangent at the contact point of said blade with the surface of said photoconductor drum is less than $\pi/2$.

2. A cleaning apparatus of an electrophotographic copying machine as claimed in claim 1, wherein a layer of a vibration-absorbing material is applied to the opposing surfaces of said parallel elastic plates.

3. A cleaning apparatus of an electrophotographic copying machine as claimed in claim 1, wherein a pad of vibration-absorbing material fills the space between said parallel elastic plates.

4. A cleaning apparatus for cleaning residual toner from the surface of a rotatable photoconductor drum of an electrophotographic copying machine, comprising:

an arm and means for urging said arm toward the surface of said photoconductor drum;

a pair of elongated, parallel, upper and lower, elastic plates each having a rear end and a front end, said rear ends of said elastic plates being fixed to said arm so that said elastic plates are urged by said arm toward the surface of said photoconductor drum, said elastic plates extending from said arm toward the surface of said photoconductor drum, said front ends of said elastic plates being located close to but spaced laterally from the surface of said photoconductor drum and being integrally connected to each other, said elastic plates, the connections thereof to said arm and the connection between the front ends thereof defining a rectangular enclosure therebetween;

an elastic cleaning blade fixed to the lower side of said lower elastic plate and having a free end portion projecting forwardly from said front end of said lower elastic plate, the length l of said free end portion satisfying the relation $0<l\leqq 2h$ wherein h is the thickness of said blade, said free end portion having a forward end which is pressed against the upwardly moving surface of said photoconductor drum with a predetermined pressure, the contact angle defined between (1) the lower surface of said cleaning blade at the point of contact of said cleaning blade with the upwardly moving surface of said photoconductor drum and (2) a tangent to the surface of said photoconductor drum at said point of contact, being an acute angle;

the forward portions of said elastic plates and said blade being capable of flexing upwardly relative to said arm and said photoconductor drum so that the forward end of said blade can move upwardly while remaining in contact with the surface of said photoconductor drum and while maintaining said contact angle substantially constant.

* * * * *